US006977572B2

(12) United States Patent
Kawai et al.

(10) Patent No.: US 6,977,572 B2
(45) Date of Patent: Dec. 20, 2005

(54) STICK-SHAPED IGNITION COIL HAVING INTERNAL HOLE FOR RESIN

(75) Inventors: Kazuhide Kawai, Kariya (JP); Shouichi Takeyama, Hashima (JP); Masahiko Aoyama, Kariya (JP)

(73) Assignee: Denso Corporation, (JP)

( * ) Notice: Subject to any disclaimer, the term of this patent is extended or adjusted under 35 U.S.C. 154(b) by 0 days.

(21) Appl. No.: 11/100,468

(22) Filed: Apr. 7, 2005

(65) Prior Publication Data

US 2005/0242914 A1 Nov. 3, 2005

(30) Foreign Application Priority Data

Apr. 30, 2004 (JP) ..... 2004-135570

(51) Int. Cl.[7] ..... H01F 27/02
(52) U.S. Cl. ..... 336/90; 336/96; 123/634
(58) Field of Search ..... 336/90–96, 107, 336/192, 198; 123/634–635

(56) References Cited

U.S. PATENT DOCUMENTS 5,977,856 A * 11/1999 Maekawa et al. ..... 336/96
6,005,464 A 12/1999 Sakamaki et al. ..... 336/96
6,023,215 A 2/2000 Sakamaki et al. ..... 336/96
6,094,121 A 7/2000 Sakamaki et al. ..... 336/96
6,169,471 B1 1/2001 Sakamaki et al. ..... 336/96
6,469,608 B2 * 10/2002 Shimoide et al. ..... 336/90
6,525,636 B1 * 2/2003 Oosuka et al. ..... 336/90
6,653,922 B2 * 11/2003 Sano et al. ..... 336/96

* cited by examiner

*Primary Examiner*—Tuyen T Nguyen
(74) *Attorney, Agent, or Firm*—Nixon & Vanderhye PC

(57) ABSTRACT

A stick-shaped ignition coil includes a center core, a primary coil, a secondary coil, and a body case that are substantially coaxially arranged relative to each other. The ignition coil further includes an igniter, a head case, a holder, and an electrically insulative resin. The head case accommodates the igniter. The head case is provided to an upper end portion of the body case. The holder is arranged between the igniter and upper ends of all the center core, the primary coil, and the secondary coil. The electrically insulative resin is filled in a first space, which is formed among the center core, the primary coil, the secondary coil, the body case, and the holder. The holder has at least one resin flow hole, through which epoxy resin is supplied into the first space, and at least one vent hole, through which air in the first space is vented to an outside.

21 Claims, 3 Drawing Sheets

STICK-SHAPED IGNITION COIL HAVING INTERNAL HOLE FOR RESIN

CROSS REFERENCE TO RELATED APPLICATIONS

This application is based on and incorporates herein by reference Japanese Patent Application No. 2004-135570 filed on Apr. 30, 2004.

FIELD OF THE INVENTION

The present invention relates to a stick-shaped ignition coil that has a coil portion, which internally form a gap, through which electrically insulative resin flows, so that the gap is filled with the electrically insulative resin.

BACKGROUND OF THE INVENTION

A stick-shaped ignition coil includes a coil portion and a controller. The coil portion has a cylindrical body case that accommodates a center core, a primary coil and a secondary coil. The controller has a boxy head case that accommodates an igniter. The center core, the primary coil, and the secondary coil form a gap in the body case thereamong. Epoxy resin is filled into the gap through the head case, and the epoxy resin is solidified to be an electrically insulative resin. The gap opens to only the upper side, and extends lengthwise to the lower side. Accordingly, epoxy resin is difficult to be entirely filled throughout the gap.

As shown in FIG. 4, in a conventional ignition coil disclosed in JP-A-10-74652 (U.S. Pat. No. 6,169,471, U.S. Pat. No. 6,094,121, U.S. Pat. No. 6,023,215, and U.S. Pat. No. 6,005,464), a body case 100 accommodates a center core 102, a primary coil 103, and a secondary coil 104. Negative pressure is developed inside the body case 100, so that epoxy resin is filled into the body case 100. Epoxy resin is supplied from a head case 107, and the epoxy resin flows into a gap formed in the body case 100 through a gap between an igniter 108 and the circumferential wall of the body case 100. The epoxy resin is supplied into a resin supplying portion 109 of the head case 107 through a nozzle 110 by a constant volume. When the epoxy resin is excessively supplied into the resin supplying portion 109, excessive epoxy resin overflows around the resin supplying portion 109. Furthermore, the body case 100 is communicated with the head case 107 through a pipe 112, so that air in the body case 100 is vented to the side of the head case 107.

In the conventional structure of the ignition coil, epoxy resin is supplied into the resin supplying portion 109 by the constant amount, so that the epoxy resin is not excessively supplied. However, the resin supplying portion 109 is not effective for enhancing inflow of epoxy resin into the gap in the body case 100.

In addition, an outer core is provided to the outer circumferential side of the primary coil 103 and the secondary coil 104. The outer core is formed in such a manner that a magnetic rectangular plate is bent to be in a C-shape in cross section, so that the outer core is attached to the body case 100. When the outer core is attached to the inner circumferential periphery of the body case 100, resin flows into a gap, which is formed between the inner circumferential periphery of the outer core and the outer circumferential periphery of one of the primary spool and secondary spool, which is on the radially outer side. Thereby, air flows out of the outer core through a pair of slits formed on both radially end sides of the outer circumferential periphery of the outer core, so that epoxy resin and air smoothly flow through the gap in the outer core.

However, when the outer core is attached to the outer circumferential periphery of the body case 100, the gap formed between the inner circumferential periphery of the body case 100 and the outer circumferential periphery of the one of the primary spool and the secondary spool, which is on the outer side, may be circumferentially uniform. Accordingly, inflow of epoxy resin may interfere with outflow of air.

Here, a holder is provided to fix a physical relationship among the center core 102, primary coil 103 and the secondary coil 104. The holder is attached to the directly lower side of the igniter 108, so that the holder covers the center core 102. Thus, the opening of the body case 100 on the upper end side is covered with the igniter 108 and the holder. Accordingly, forming a hole, through which resin flows, becomes difficult.

SUMMARY OF THE INVENTION

In view of the foregoing problems, it is an object of the present invention to produce a stick-shaped ignition coil that has a structure, in which epoxy resin, which is supplied into a head case, easily flows into a gap in a body case, and air in the gap in the body case is easily vent to the head case, even when a holder is arranged on the lower side of an igniter.

According to the present invention, a stick-shaped ignition coil includes a center core, a primary coil, a secondary coil, a body case, an igniter, a head case, a holder, and an electrically insulative resin. The primary coil is arranged on an outer circumferential side of the center core. The secondary coil is arranged on the outer circumferential side of the center core. The body case is arranged on the outer circumferential side of one of the primary coil and the secondary coil, which is on the outer circumferential side of the other of the primary coil and the secondary coil. The head case accommodates the igniter. The head case is provided to an upper end portion of the body case. The holder is arranged between the igniter and upper end portions of all the center core, the primary coil, and the secondary coil. The electrically insulative resin is filled in a first space, which is formed of a gap defined among the center core, the primary coil, the secondary coil, the body case, and the holder. The holder defines at least one resin flow hole, through which epoxy resin is supplied into the first space. The holder defines at least one vent hole, through which air in the first space is vented to an outside.

The at least one resin flow hole is arranged on a substantially opposite side of the at least one vent hole with respect to a center of the holder. The holder includes a protruding portion that protrudes from a periphery of the igniter. The protruding portion defines the at least one resin flow hole. The holder is arranged coaxially with respect to the body case. The igniter is arranged offset with respect to the holder in a radial direction of the head case. Each resin flow hole has a funnel shape.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS (Embodiment)

Figure 1:
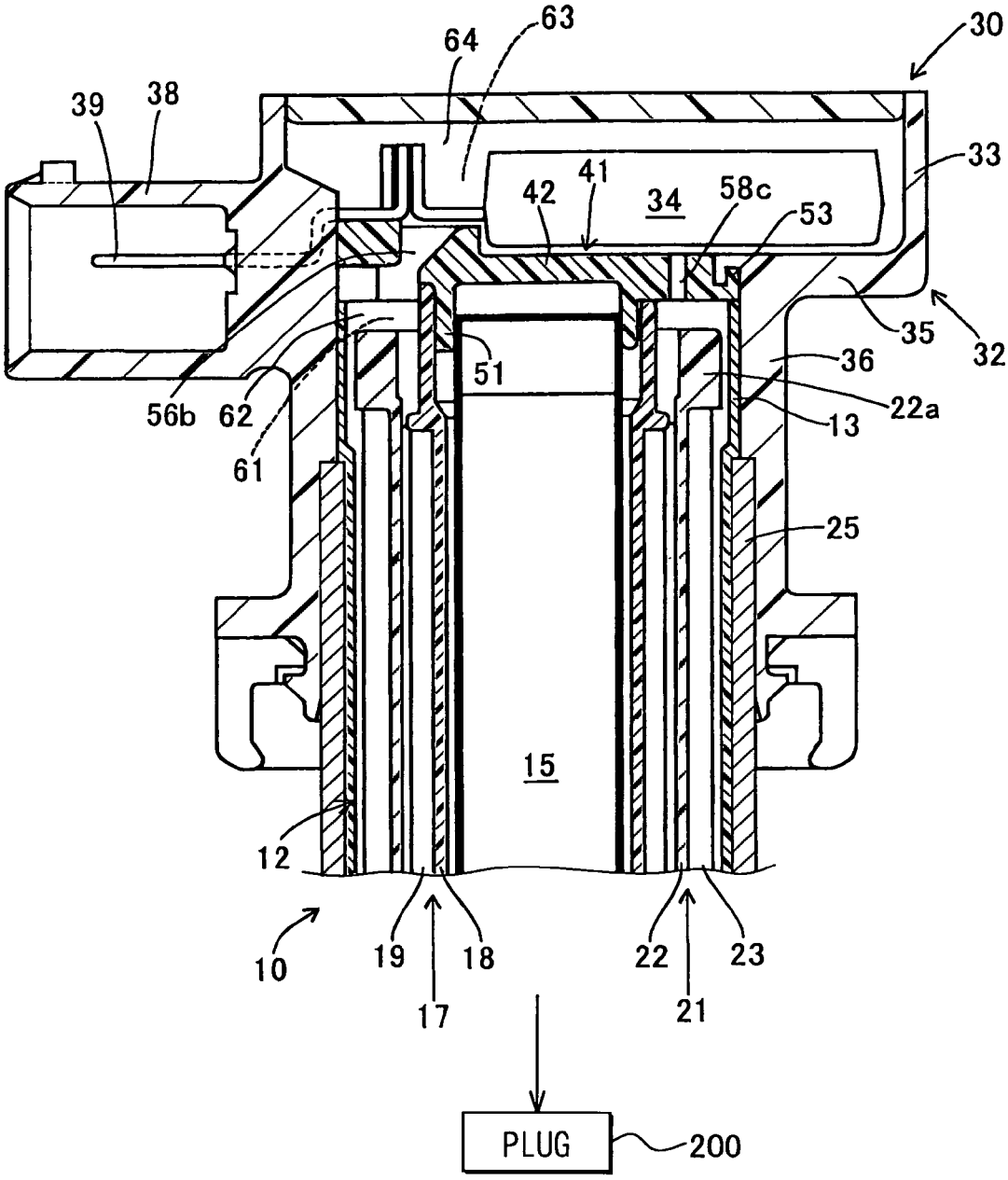
FIG. 1 is a partially cross-sectional side view showing a stick-shaped ignition coil according to an embodiment of the present invention.

As shown in FIG. 1, a stick-shaped ignition coil is constructed of a coil portion 10, a controller 30, and a high voltage tower portion (not shown). The coil portion 10 is located in an axially intermediate portion of the ignition coil. The controller 30 is located on the upper side of the ignition coil. The high voltage tower portion is located on the lower side of the ignition coil. The coil portion 10 includes a center core 15, a secondary coil 17, and a primary coil 21, which are accommodated in a cylindrical body case 12. The coil portion 10 further includes an outer core 25, which is attached to the outer circumferential periphery of the body case 12. The secondary coil 17 is arranged on the outer circumferential side of the center core 15. The secondary coil 17 is constructed of a cylindrical secondary spool 18, which is electrically insulative, and a secondary winding 19, which is wound around the outer circumferential periphery of the secondary spool 18. The primary coil 21 is arranged on the outer circumferential side of the secondary coil 17. The primary coil 21 is constructed of a primary spool 22 and a primary winding 23, similarly to the secondary coil 17.

The body case 12 has a concavity on the outer circumferential periphery thereof. The outer core 25 is provided to the concavity of the body case 12 such that the outer core 25 radially opposes to the center core 15. The outer core 25, which is in a C-shape in cross section with respective to the axial direction thereof, has the inner diameter, which is less than the outer diameter of an upper end portion 13 of the body case 12. The outer core 25 has the outer diameter, which is greater than the outer diameter of the upper end portion 13. That is, the outer diameter of the upper end portion 13 is greater than the inner diameter of the outer core 25, and is less than the outer diameter of the outer core 25.

The controller 30 includes a head case 32 and an igniter 34. The igniter 34 is accommodated in the head case 32.

A holder 41 holds the igniter 34, so that the igniter 34 is steadily secured at a predetermined position in the head case 32.

The head case 32 includes an accommodating portion 33, an engaging portion 36, and a connector 38. The accommodating portion 33, which is in a box shape, accommodates the igniter 34. The connector 38 laterally extends from the accommodating portion 33. Terminals 39 are attached to the connector 38. The engaging portion 36, which is in a cylindrical shape, downwardly extends from the accommodating portion 33. The engaging portion 36 is press-inserted onto the upper end portion 13 of the body case 12 such that the engaging portion 36 covers the upper end potion of the outer core 25.

The holder 41 covers the upper end of the center core 15, the secondary coil 17, and the primary coil 21. The holder 41 includes a disc-shaped body 42, a cylindrical portion 51, and a hooking portion 53. The cylindrical portion 51 downwardly extends from the lower surface of the body 42.

The hooking portion 53 is formed on the outer circumferential periphery of the body 42. The body 42 is mounted onto the upper end surface of the center core 15. The cylindrical portion 51 is inserted into a gap between the center core 15 and the secondary spool 18. The cylindrical portion 51 aligns the center of the center core 15. The hooking portion 53 hooks to the inner circumferential periphery of the head case 32.

The cylindrical portion 51 of the holder 41 coaxially aligns the center core 15. That is, the cylindrical portion 51 of the holder 41 radially positions the center core 15, so that the cylindrical portion 51 and the center core 15 are coaxially arranged relative to each other.

A gap is formed between the secondary winding 19 and the primary spool 22. Another gap is formed between the primary winding 23 and the body case 12. Another gap is formed among the holder 41, the center core 15, and the like. The three gaps communicate with each other to form a first space 61, which is closed. Epoxy resin, which is in liquid form, flows into the first space 61, and the epoxy resin in the first space 61 is heated to be solidified, so that the epoxy resin in the first space 61 becomes a first electrically insulative resin 62.

Figure 2:
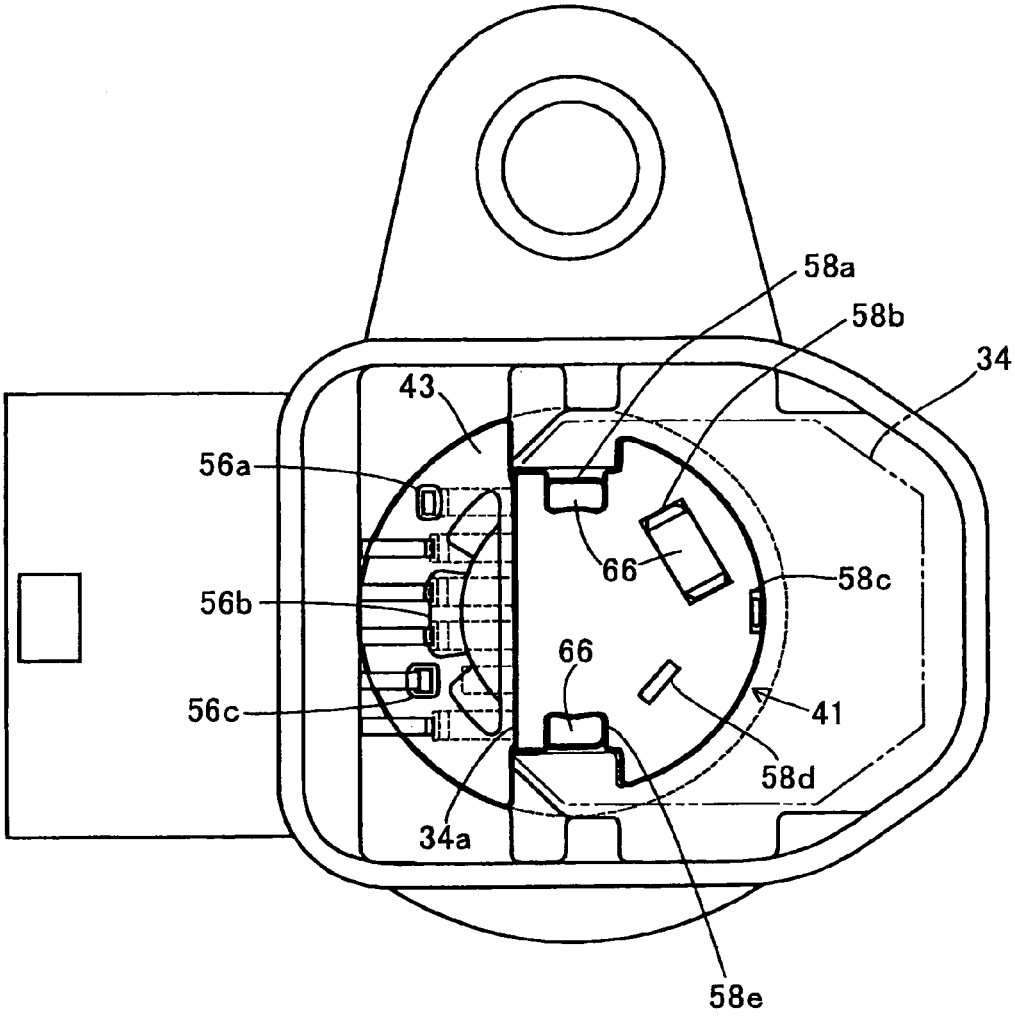
FIG. 2 is a top view showing the stick-shaped ignition coil according to the embodiment.

As shown in FIGS. 1, 2, the igniter 34, which is in a substantially rectangular shape, is arranged offset with respective to the holder 41, which is in a circular shape, in the radial direction. The igniter 34 is arranged offset to the right side in FIG. 1. A distance, in which the igniter 34 is arranged offset relative to the holder 41, is slightly smaller than the radius of the holder 41. As a result, as shown in FIG. 2, a left end periphery 34*a* of the igniter 34 deviates from the center of the holder 41 to the left side in FIG. 2. That is, a left half body (protruding portion) 43 of the holder 41 protrudes from the left end periphery 34*a* of the igniter 34 to the left side in FIG. 2.

The protruding portion 43 has multiple resin flow holes 56*a*, 56*b*, 56*c*, which are respectively in small rectangular shapes. The resin flow holes 56*a*, 56*b*, 56*c* are formed corresponding to the terminals 39 such that the resin flow holes 56*a*, 56*b*, 56*c* communicate with a portion of the first space 61 on the left side in FIG. 1. The resin flow hole 56*b*, which is relatively large, is in a funnel shape such that the inner diameter of the resin flow hole 56*b* gradually decrease from the upper side thereof to the lower side thereof.

Any one of the resin flow holes 56*a* to 56*c* may be in funnel shapes. That is, the resin flow holes 56*a* to 56*c* respectively opens to the first space 61 through a first opening area, and the resin flow holes 56*a* to 56*c* respectively opens to the second space 63 through a second opening area. Besides, the second opening area is greater than the first opening area. That is, each resin flow holes 56*a* to 56*c* respectively has a cross sectional area that decreases toward the first space 61.

Multiple vent holes 58*a*, 58*b*, 58*c*, 58*d*, 58*e*, which are in rectangular shapes, are formed to be circumferentially apart from each other. The vent holes 58*a* to 58*e* communicate with a portion of the first space 61 on the right side in FIG. 1. The vent holes 58*a*, 58*b*, 58*e* are formed of peripheries of mounting holes of a diode 66, and are located on the lower side of the igniter 34.

The diode 66 restricts an ignition plug 200 from igniting when the primary coil 21 is turned ON. The holder 41 holds the diode 66, so that the diode 66 is steadily secured at a predetermined position in the head case 32.

The ignition coil is assembled in the following manner. The center core 15, the secondary coil 17, and the primary coil 21 are inserted into the body case 12. The holder 41 is mounted to the upper end of the body case 12 such that the holder 41 covers the upper end of the body case 12. The engaging portion 36 of the head case 32 is press inserted onto the upper end portion 13 of the body case 12. The igniter 34 is attached to the inside of the accommodating portion 33. Negative pressure is developed inside the first space 61. Subsequently, epoxy resin, which is in liquid form, is supplied into a second space 63 in the accommodating portion 33.

The epoxy resin enters from the resin flow holes 56*a* to 56*c*, and circumferentially flows in the first space 61 to the axially lower side. The epoxy resin is filled from the left side to the right side in FIG. 1. Thereby, the epoxy resin flows throughout the gap, which is formed between the secondary winding 19 and the primary spool 22, the gap, which is formed between the primary winding 23 and the body case 12, and the gap, which is formed among the holder 41, the center core 15, and the like. As epoxy resin flows, air in the first space 61 is exhausted to the second space 63 through the vent holes 58*a* to 58*e*. Epoxy resin filled in the first space 61 is solidified to be the first electrically insulative resin 62. Epoxy resin filled in the second space 63 is solidified to be a second electrically insulative resin 64.

In the above structure of the ignition coil, the resin flow holes 56*a* to 56*c* are formed in the protruding portion 43 of the holder 41, and the igniter 34 is not arranged on the upper side of the resin flow holes 56*a* to 56*c*. Thereby, epoxy resin, which is supplied into the first space 61 of the head case 32, can easily flow into the first space 61 of the body case 12, even the holder 41 is arranged on the upper end of the center core 15 and the like. In addition, epoxy resin flows through the multiple rectangular holes, which are formed along the terminals 39, so that epoxy resin can be quickly filled. Furthermore, the rectangular holes are in the funnel shapes, so that epoxy resin can easily flow through the rectangular holes.

In the above structure, the outer diameter of the upper end portion 13 of the body case 12 is greater than the inner diameter of the outer core 25, and is less than the outer diameter of the outer core 25. Thereby, the outer core 25 can be easily attached to the outer circumferential periphery of the body case 12. Besides, a passage, through which epoxy resin flows, can be easily formed between an upper end collar portion 22*a* (FIG. 1) of the primary spool 22 and the upper end portion 13 of the body case 12. Difference between the inner diameter of the outer core 25 and the outer diameter of the upper end portion 13 is small. Thereby, when the outer core 25, which is in C-shape in cross section, is radially opened to be axially inserted through the upper end collar portion 22*a*, the outer core 25 need not to be largely opened. In addition, a gap is formed between the upper end collar portion 22*a* of the primary spool 22 and the upper end portion 13 of the body case 12, so that epoxy resin can easily flow into the gap between the primary winding 23 and the body case 12.

In the above structure, the vent holes 58*a* to 58*e* are formed in the holder 41, so that air in the first space 61 is restricted from increasing in pressure. Thereby, inflow of epoxy resin is enhanced. Besides, the resin flow holes 56*a* to 56*c* are formed on the opposite side of the vent holes 58*a* to 58*e* with respect to the center of the holder 41. That is, the resin flow holes 56*a* to 56*c* are apart from the vent holes 58*a* to 58*e* in the circumferential direction of the holder 41. Thereby, a passage, through which epoxy resin flows, is separated from a passage, through which air flows, in the first space 61, so that air remaining in the first space 61 can be restricted from blocking inflow of epoxy resin into the first space 61.

(First Variation)

Figure 3A:
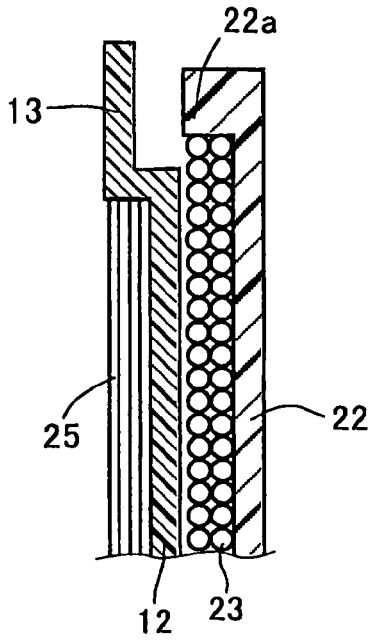
FIG. 3A is a partially cross-sectional side view showing a stick-shaped ignition coil according to a first variation of the embodiment.

In a first variation shown in FIG. 3A, the outer core 25 is provided to the concavity formed in the outer circumferential periphery of the body case 12. Besides, the inner circumferential periphery of the body case 12 protrudes to the radially inner side. The outer diameter of the outer core 25 is substantially the same as the outer diameter of the upper end portion 13 of the body case 12. The upper end portion 13 is circumferentially bent. The inner diameter of the outer core 25 is smaller than the outer diameter of the upper end portion 13.

In this structure, a gap can be easily formed between the upper end portion 13 of the body case 12 and the upper end collar portion 22*a* of the primary spool 22, so that epoxy resin can be easily flow into the gap.

(Second Variation)

Figure 3B:
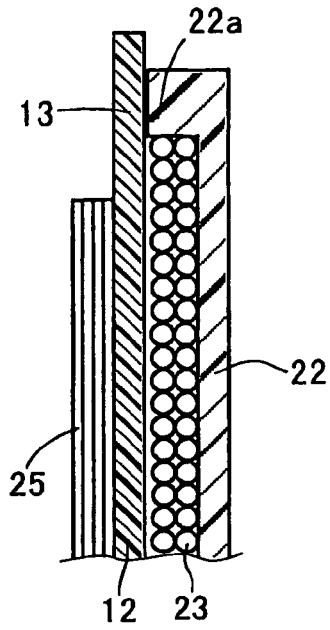
FIG. 3B is a partially cross-sectional side view showing a stick-shaped ignition coil according to a second variation of the embodiment.
Figure 4:
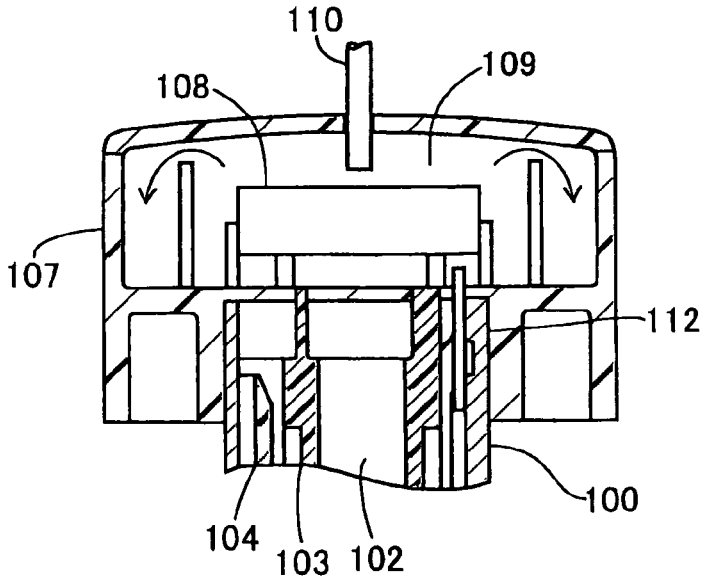
FIG. 4 PRIOR ART
FIG. 4 is a partially cross-sectional side view showing a stick-shaped ignition coil according to a prior art.

In a second variation shown in FIG. 3B, the upper end portion 13 of the body case 12 is not bent, and the inner diameter of the outer core 25 is substantially the same as the outer diameter of the upper end portion 13. Thereby, the outer core 25 can be easily attached to the body case 12.

In the above structure of the stick-shaped ignition coil, the resin flow holes 56*a* to 56*c* and the vent holes 58*a* to 58*e* are formed in the holder 41. Thereby, epoxy resin, which is supplied into the head case 32, can easily flow through the gap among components in the body case 12, even the holder 41 is located between the igniter 34 and center core 15 in the axial direction of the ignition coil. Besides, air in the gap can be easily vented to the outside of the body case 12.

The passage, through which epoxy resin flows, and the passage, through which air flows, are distinguished from each other in the body case 12, so that epoxy resin can smoothly flow throughout the inner space of the body case 12. The resin flow holes 56*a* to 56*c* are in funnel shapes, so that epoxy resin can easily gather around the resin flow holes 56*a* to 56*c*, which are funnelform, from the space in the head case 32. Besides, epoxy resin can flow from the resin flow holes 56*a* to 56*c* into the gap in the body case 12. In the above structure of the outer core 25 and the upper end portion 13 of the body case 12, epoxy resin can easily flow throughout the body case 12, even the outer core 25 is arranged on the side of circumferential periphery of the body case 12.

The body case 12, which is in an elongated cylindrical shape, has a hollow center portion, in which the center core 15 is arranged. The primary coil 21 and the secondary coil 17 are arranged on the radially outer side of the center core 15 in the coil portion 10. Either one of the primary coil 21 or the secondary coil 17 may be arranged on the outer circumferential side with respect to the other one of the primary coil 21 and the secondary coil 17. The outer core 25 can be provided to either the inner circumferential periphery of the body case 12 or the outer circumferential periphery of the body case 12. The outer core 25 is arranged on the concavity formed on the outer circumferential periphery of the body case 12. In this structure, the inner diameter of the outer core 25 is preferably less than the outer diameter of the upper end portion (upper end collar portion) 13 of the body case 12, and the outer diameter of the outer core 25 is preferably greater than the outer diameter of the body case 12.

The first space 61 includes the gap between the center core 15 and the holder 41, the gap between the winding 23 on the radially inner side and the spool 22 on the radially outer side, and the gap between the winding 23 on the radially outer side and the body case 12. The first space 61 is filled with the first electrically insulative resin 62.

The controller 30 includes the head case 32, the igniter 34, and the like. The head case 32 includes the accommodating portion 33 and the engaging portion 36. The igniter 34 is accommodated in the accommodating portion 33. The second space 63 around the igniter 34 is filled with the second electrically insulative resin 64. The engaging portion 36 is press-inserted onto the upper end portion 13 of the body case 12. The holder 41 is in a disc shape. The holder 41 is mounted onto the upper ends of all the center core 15, the secondary coil 17, and the primary coil 21, so that the holder 41 adjusts physical relationship among the center core 15, the secondary coil 17, and the primary coil 21, which are coaxially arranged relative to each other. The holder 41 covers the opening formed on the upper end side of the body case 12. The holder 41 is arranged between the upper end of the center core 15 and the igniter 34 in the axial direction of the ignition coil. That is, the holder 41 is located on the lower side of the igniter 34. The igniter 34 is preferably arranged offset relative to the holder 41, which is coaxially arranged with respect to the body case 12, in the radial direction of the body case 12. That is, the igniter 34 is preferably deviated, i.e., displaced to one side in the radial direction of the body case 12. As a result, a part (protruding portion) 43 of the holder 41 radially protrudes from the igniter 34.

The resin flow holes 56*a* to 56*c* and the vent holes 58*a* to 58*e* are formed in the holder 41. The resin flow holes 56*a* to 56*c* are preferably formed in the protruding portion 43 of the holder 41. The resin flow holes 56*a* to 56*c* include at least one small hole that communicates the first space 61 of the body case 12 with the second space 63 of the head case 32. Each resin flow hole 56*a* to 56*c* may have the funnel shape. The lower end of the resin flow hole 56*a* to 56*c* opens to the gap between the upper end of the center core 15 and the holder 41. The upper end of the resin flow hole 56*a* to 56*c* preferably opens to the gap between the body case 12 and the secondary spool 18, so that epoxy resin can easily flow through the resin flow hole 56*a* to 56*c* and the gap.

The vent holes 58*a* to 58*e* include at least one small hole that communicates the first space 61 of the body case 12 with the second space 63 of the head case 32. The resin flow holes 56*a* to 56*c* and the vent holes 58*a* to 58*e* are preferably arranged to be opposite to each other with respect to the center of the holder 41. The total opening area of the resin flow holes 56*a* to 56*c* is preferably greater than the total opening area of the vent holes 58*a* to 58*e*.

The structures of the above embodiment and variations can be combined as appropriate. Various modifications and alternations may be diversely made to the above embodiment without departing from the spirit of the present invention.

What is claimed is:

1. A stick-shaped ignition coil comprising:

a center core;

a primary coil that is arranged on an outer circumferential side of the center core;

a secondary coil that is arranged on the outer circumferential side of the center core;

a body case that is arranged on an outer circumferential side of one of the primary coil and the secondary coil, which is on the outer circumferential side of the other of the primary coil and the secondary coil;

an igniter;

a head case that accommodates the igniter, the head case being provided to an upper end portion of the body case;

a holder that is arranged between the igniter and upper end portions of all the center core, the primary coil, and the secondary coil; and an electrically insulative resin that is filled in a first space, which is formed of a gap defined among the center core, the primary coil, the secondary coil, the body case, and the holder, wherein the holder defines at least one resin flow hole through which epoxy resin is supplied into the first space, and the holder defines at least one vent hole through which air in the first space is vented to an outside.

2. The stick-shaped ignition coil according to claim 1, wherein the at least one resin flow hole is arranged on an opposite side of the at least one vent hole with respect to a center of the holder.

3. The stick-shaped ignition coil according to claim 1, wherein the holder includes a protruding portion that protrudes from a periphery of the igniter, and the protruding portion defines the at least one resin flow hole.

4. The stick-shaped ignition coil according to claim 3, wherein the holder is arranged coaxially with respect to the body case, and the igniter is arranged offset with respect to the holder in a radial direction of the head case.

5. The stick-shaped ignition coil according to claim 3, wherein the holder is arranged coaxially with respect to the body case, and the igniter is displaced with respect to the holder in a radial direction of the head case.

6. The stick-shaped ignition coil according to claim 1, wherein each resin flow hole has a funnel shape.

7. The stick-shaped ignition coil according to claim 1, wherein the head case defines a second space into which the epoxy resin is supplied, and each resin flow hole communicates the second space with the first space.

8. The stick-shaped ignition coil according to claim 7, wherein each resin flow hole opens to the first space through a first opening area, each resin flow hole opens to the second space through a second opening area, and the second opening area is greater than the first opening area.

9. The stick-shaped ignition coil according to claim 1, further comprising:

an outer core that is provided to an outer circumferential periphery of the body case, the outer core being in a C-shape in cross section, wherein the outer core has an inner diameter that is less than an outer diameter of an upper end collar portion of the body case, and the outer core has an outer diameter that is greater than the outer diameter of the upper end collar portion of the body case.

10. The stick-shaped ignition coil according to claim 1, wherein the holder includes a cylindrical portion that aligns a center of the center core.

11. The stick-shaped ignition coil according to claim 1, further comprising:

a diode, wherein the holder holds the diode.

12. The stick-shaped ignition coil according to claim 1, wherein the holder holds the igniter.

13. The stick-shaped ignition coil according to claim 1, wherein all the at least one resin flow holes has a total opening area that is greater than a total opening area of all the at least one vent holes.

14. A stick-shaped ignition coil that ignites an ignition plug, the stick-shaped ignition coil comprising:

a center core;

a primary coil that is arranged on an outer circumferential side of the center core;

a secondary coil that is arranged on the outer circumferential side of the center core;

a body case that is arranged on an outer circumferential side of one of the primary coil and the secondary coil, which is on the outer circumferential side of the other of the primary coil and the secondary coil;

an igniter that ignites the ignition plug;

a head case that accommodates the igniter, the head case being provided to one end portion of the body case;

a holder that holds the igniter, the holder coaxially holding one axial end portion of the center core, wherein the igniter, the holder, the center core are arranged in this order in an axial direction of the center core, the body case defines a first space therein among the center core, the primary coil, the secondary coil, and the holder, the stick-shaped ignition coil further comprising:

an electrically insulative resin that is formed of epoxy resin, the electrically insulative resin being filled in the first space, wherein the holder defines at least one resin flow hole through which epoxy resin flows into the first space to be the electrically insulative resin, the holder defines at least one vent hole through which air in the first space is vented to an outside, and the at least one resin flow hole is arranged on a substantially opposite side of the at least one vent hole with respect to a center of the holder in the radial direction of the holder.

15. The stick-shaped ignition coil according to claim 14, wherein the holder includes a protruding portion that protrudes from a periphery of the igniter in the radial direction of the holder, and the protruding portion defines the at least one resin flow hole.

16. The stick-shaped ignition coil according to claim 14, wherein the holder is arranged coaxially with respect to the body case, and the igniter is arranged offset with respect to the holder in a radial direction of the head case.

17. The stick-shaped ignition coil according to claim 14, wherein each resin flow hole has a funnel shape, in which a cross sectional area of each resin flow hole decreases toward the first space.

18. The stick-shaped ignition coil according to claim 14, further comprising:

an outer core that is provided to an outer circumferential periphery of the body case, the outer core being in a C-shape in cross section, wherein the outer core has an inner diameter that is less than an outer diameter of an upper end collar portion of the body case, and the outer core has an outer diameter that is greater than the outer diameter of the upper end collar portion of the body case.

19. The stick-shaped ignition coil according to claim 14, wherein the holder includes a cylindrical portion that coaxially aligns the center core.

20. The stick-shaped ignition coil according to claim 14, further comprising:

a diode that restricts the ignition plug from igniting when the primary coil is turned ON, wherein the holder holds the diode.

21. The stick-shaped ignition coil according to claim 14, wherein all the at least one resin flow holes has a total opening area that is greater than a total opening area of all the at least one vent holes.

* * * * *